US007641417B2

(12) United States Patent
Barker

(10) Patent No.: US 7,641,417 B2
(45) Date of Patent: Jan. 5, 2010

(54) TIRE DEFLATION DEVICE

(75) Inventor: Stacey G. Barker, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 37 days.

(21) Appl. No.: 12/136,901

(22) Filed: Jun. 11, 2008

(65) Prior Publication Data

US 2008/0236715 A1 Oct. 2, 2008

Related U.S. Application Data

(62) Division of application No. 11/103,747, filed on Apr. 11, 2005, now abandoned.

(51) Int. Cl.
*E01F 13/12* (2006.01)

(52) U.S. Cl. ..... 404/6

(58) Field of Classification Search ..... 404/6
See application file for complete search history.

(56) References Cited

U.S. PATENT DOCUMENTS

| | | | | |
|---|---|---|---|---|
| 1,930,603 | A | 10/1933 | White | |
| 1,932,700 | A | 10/1933 | Kolomyjec | |
| 2,332,852 | A | 10/1943 | Johnson | |
| 2,559,464 | A | 7/1951 | Roberg | |
| 3,680,272 | A | 8/1972 | Meyer | |
| 4,245,377 | A | 1/1981 | Soltes | |
| 4,367,602 | A | 1/1983 | Petersen | |
| 4,505,058 | A | 3/1985 | Petersen | |
| 4,559,679 | A | 12/1985 | Downey | |
| 4,995,756 | A | 2/1991 | Kilgrow et al. | |
| 5,253,950 | A | 10/1993 | Kilgrow et al. | |
| 5,452,962 | A | 9/1995 | Greves | |
| 5,498,102 | A | 3/1996 | Bissell | |
| 5,507,588 | A | 4/1996 | Marts et al. | |
| RE35,373 | E | 11/1996 | Kilgrow et al. | |
| 5,649,783 | A | 7/1997 | Ichikawa et al. | |
| 5,775,832 | A | 7/1998 | Kilgrow et al. | |
| 5,820,293 | A | 10/1998 | Groen et al. | |
| 5,904,443 | A | 5/1999 | Soleau | |
| 5,921,704 | A | 7/1999 | Pacholok et al. | |
| 6,048,128 | A | 4/2000 | Jones, III et al. | |
| 6,155,745 | A | 12/2000 | Groen et al. | |
| 6,220,781 | B1 | 4/2001 | Miller | |
| 6,357,961 | B1 * | 3/2002 | Marphetia | 404/6 |
| 6,551,013 | B1 | 4/2003 | Blair | |
| 6,749,362 | B1 | 6/2004 | Eichenberg | |
| 6,758,628 | B1 | 7/2004 | Curry, Jr. | |
| 7,037,032 | B1 * | 5/2006 | Marphetia | 404/6 |
| 7,278,189 | B2 | 10/2007 | Smith | |
| 2004/0244156 | A1 | 12/2004 | Jackson et al. | |
| 2005/0076484 | A1 | 4/2005 | Sussenbach et al. | |
| 2006/0228176 | A1 * | 10/2006 | Barker | 404/6 |

* cited by examiner

*Primary Examiner*—Gary S Hartmann
(74) *Attorney, Agent, or Firm*—Wells, St. John

(57) ABSTRACT

A tire deflation device includes (1) a component having a plurality of bores, (2) a plurality of spikes removably insertable into the plurality of bores and (3) a keeper within each among the plurality of bores, the keeper being configured to contact a sidewall surface of a spike among the plurality of spikes and to exert force upon the sidewall surface. In an embodiment, the tire deflation device includes (a) a component including a bore in a material, the bore including a receiving region, a sidewall surface and a base surface, (b) a channel extending from the sidewall surface into the material, (c) a keeper having a first section housed within the channel and a second section which extends past the sidewall surface into the receiving region, and (d) a spike removably insertable into the bore.

5 Claims, 5 Drawing Sheets

TIRE DEFLATION DEVICE

RELATED APPLICATIONS

This application is a Divisional of U.S. patent application Ser. No. 11/103,747 filed on Apr. 11, 2005, entitled SPIKE RETAINER, TIRE DEFLATION DEVICE, AND METHOD OF REVERSIBLY RETAINING A SPIKE, the entire subject matter of which is incorporated herein by reference.

CONTRACTUAL ORIGIN OF THE INVENTION

The United States Government has certain rights in this invention pursuant to Contract No. DE-AC07-05ID14517 between the United States Department of Energy and Battelle Energy Alliance, LLC.

TECHNICAL FIELD

The invention pertains to tire deflation devices.

BACKGROUND OF THE INVENTION

Deflation of one or more tires of a vehicle is one method that is utilized to disable or stop a vehicle. Deflation devices such as barrier strips are often utilized by law enforcement to disable a fleeing vehicle. Such devices are typically placed in the path of an oncoming vehicle and are configured to puncture one or more tires of the vehicle as the vehicle passes over the device.

A variety of deflation devices have been developed which have either solid spikes or hollow spikes. In some instances, the spikes are removable such that upon puncturing a vehicle tire the spike becomes detached from the device to remain imbedded in the tire. When a hollow type spike is utilized to puncture a tire and is retained by the tire, such can serve as an air passageway allowing air to pass through the hollow spike to efficiently deflate the tire.

Removable spikes, either hollow or solid types, can be difficult to mount utilizing conventional spike retention systems. Additionally, conventional devices can have spikes that are difficult to remove from the device such that spikes remain in the device rather than becoming lodged in the punctured tire. Further, some conventional spike retention systems allow spikes to easily disengage from the device such that spikes become lost or otherwise unintentionally removed from the device prior to tire puncture. Accordingly, it is desirable to develop alternative spike retainers and tire deflation devices.

SUMMARY OF THE INVENTION

In one aspect the invention provides a tire deflation device including a spike retainer. The spike retainer includes a bore in a material where the bore includes a receiving region, a sidewall surface and a base surface. A channel extends from the sidewall surface of the bore into the material. The spike retainer additionally includes a keeper which has a first section housed within the channel and a second section which extends past the sidewall surface into the receiving region of the bore.

In one aspect the invention provides a spike retainer which includes a bore in a component. The bore has a receiving region and a base surface. The spike retainer additionally includes a keeper which extends through the base surface and has a segment disposed within the receiving region.

In one aspect the invention provides a tire deflation device. The device includes at least one component having a plurality of bores and includes a plurality of spikes removably insertable into the plurality of bores. A keeper is provided within each of the bores and is configured to extend along a sidewall of the spike and exert force upon the sidewall.

In one aspect the invention provides a method of reversibly retaining a spike. A bore is provided in a material and a channel is provided which passes through the sidewall of the bore into the material. A keeper is positioned such that a first segment is within the channel and a second segment is disposed within a spike receiving region of the bore. A spike is inserted into the receiving region of the bore.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Numerous and diverse tire deflation devices have been developed which utilize spikes to puncture vehicle tires and thereby debilitate or disable the vehicle. In particular instances it can be preferable that the spikes be retained in a given device sufficiently to avoid or minimize unintentional loss or removal of the spikes, while allowing such spikes to be withdrawn upon sufficient force such as, for example, when the spike punctures or otherwise penetrates a vehicle tire. The aspects of the invention described below can allow spikes to be easily mounted within a device and can provide sufficient force to the mounted spikes to retain such spikes in the mounted position until the created tension is overcome by a significant force such as occurs when the spike embeds within, punctures or penetrates a vehicle tire.

Figure 1:
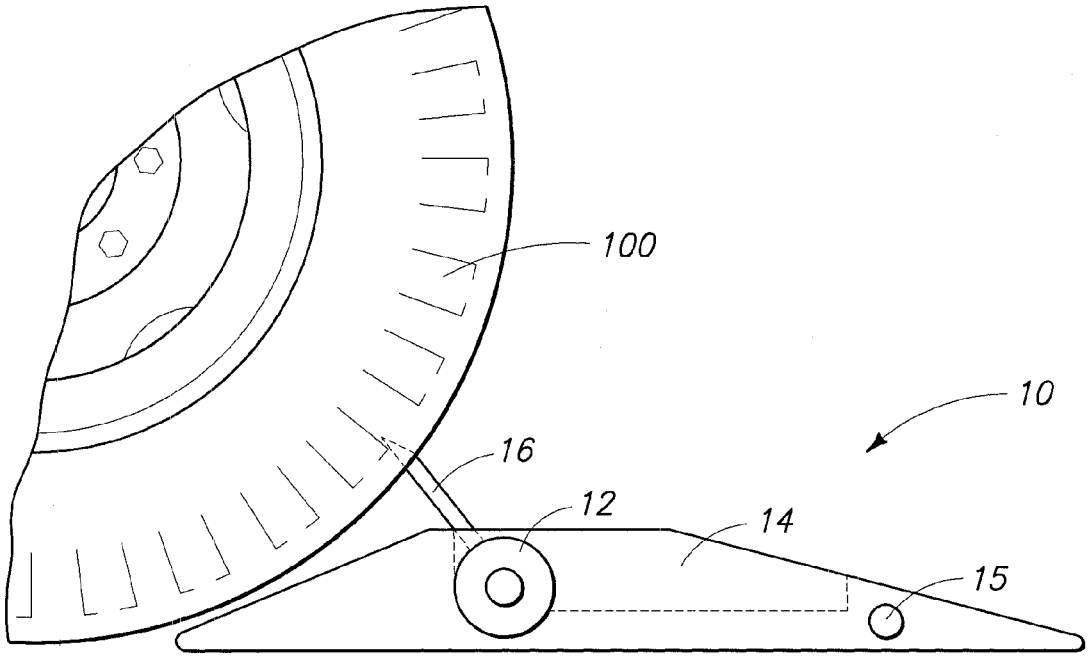
FIG. 1 is a side view of an exemplary tire deflation device which can be utilized in conjunction with the spike retainers of the present invention.
Figure 2:
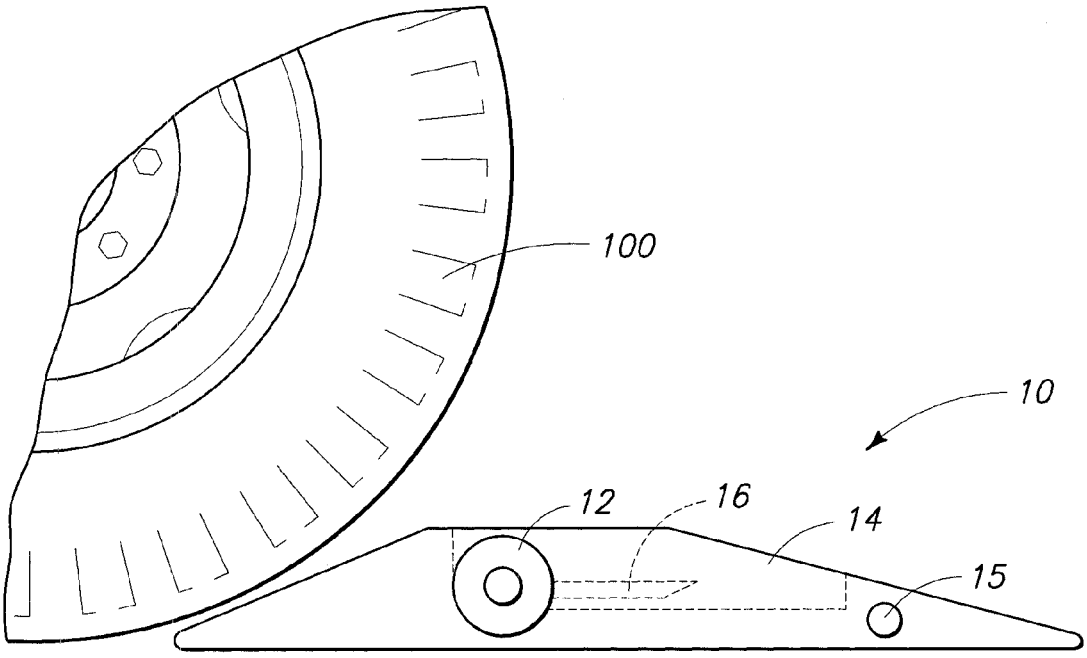
FIG. 2 is a side view of the deflation device of FIG. 1 having spikes in a retracted position.

An exemplary tire deflation device, as shown in FIGS. 1 and 2, is described in great detail in U.S. Pat. No. 5,507,588 which is hereby incorporated by reference.

Referring initially to FIG. 1, such illustrates a tire deflation device 10 having a rotatable shaft 12 in which one or more spikes 16 are retained. Spike 16 in FIG. 1 is shown as being inserted partially into a tire 100. In the exemplary device shown, rotatable shaft 12 is provided to allow rotation of spike 16 such that the spike can be housed in a recessed area 14 when the device is not in use or prior to activation or "arming" of the device. The "unarmed" device is depicted in FIG. 2 where shaft 12 is rotated such that spike 16 is recessed within device 10. In this recessed position, tire 100 can roll over device 10 without being punctured by the spike. Deployment of the device as fully described in issued U.S. Pat. No. 5,507, 588 rotates shaft 12 into an armed position similar to that shown in FIG. 1, positioning spike 16 to allow penetration and deflation of tire 100.

As described in U.S. Pat. No. 5,507,588, exemplary device 10 can comprise modules each comprising one or more spikes, and such modules can be connected or inter-joined by, for example, providing a cable through a cable passage 15.

Utilization of the spike retainers and spike retention methodology of the invention can allow easy insertion and mounting of spike 16 into a device component such as rotatable shaft 12 of the exemplary device shown. The retainers of the invention can additionally allow stable yet releasable retention of a spike in operative connection with the component 12 with a retention force that can be overcome by puncturing of a tire by the spike thereby allowing disengagement of the spike from shaft 12. These beneficial features can be also achieved in alternative barrier strip devices using retainers and methodology of the invention adapted for the particular device (not shown).

Figure 3:
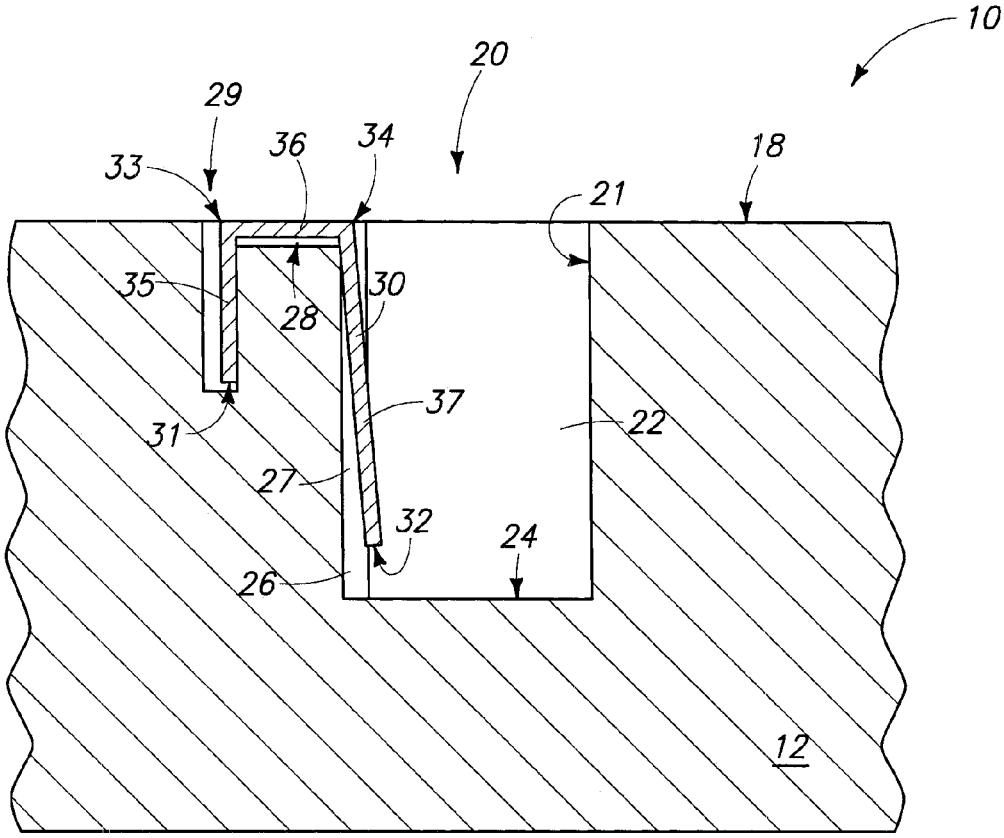
FIG. 3 is a fragmentary cross-sectional side view of a deflation device in accordance with one aspect of the invention.

Exemplary methodology and spike retainer configurations of the invention are described with reference to FIGS. 3-9. Referring initially to FIG. 3, a deflation device 10 can be provided having a component or material 12 into which a spike is to be inserted. Component 12 can be a metallic component or can comprise alternative materials such as plastics or composites. In particular aspects, component 12 can be a rotatable shaft such as illustrated in FIGS. 1 and 2. A bore 20 can be provided to extend from an outer surface 18 of component 12 into the component. Bore 20 has a spike receiving region 22 configured to receive a spike. The dimensions of bore 20 are not limited to any particular values and can be adjusted based on the dimensions of the particular spike to be utilized. As illustrated in the top view shown in FIG. 4, bore 20 can be a circular bore configured to receive a tubular or cylindrical spike. However, it is to be understood that the invention contemplates alternative bore shapes configured to receive a spike having at least a base portion which is non-circular.

In particular applications it can be preferable that bore 20 have a perimeter/circumference slightly larger that the outer circumference of the particular spike to be inserted. In an application of the invention where component 12 is a shaft such as the rotatable shaft illustrated in FIGS. 1 and 2, an exemplary spike can have an outer diameter of about ⅛ inches. Accordingly, bore 12 in this application can preferably have a bore diameter of slightly greater than about ⅛ inch. The depth of bore 20 as measured from upper surface 18 can also vary based upon the spike size and/or the size of component 12, among other things. For one particular embodiment, an exemplary bore can have a bore depth of about 0.60 inches, and a bore diameter of about 0.35 inches. It is to be understood that the bore size is not limited to any particular value. Similarly, the ratio of bore depth to bore diameter can also vary depending upon the particular application.

With reference to FIG. 3, a channel 26 can be provided to extend into material 12 through sidewall surface 21 of bore 20. Channel 26 can extend from upper surface 18 the entire depth of bore 20 to a base surface 24 as illustrated in FIG. 3. Alternatively, channel 26 can be provided to extend less than the entire bore depth from upper surface 18. Preferably, channel 26 extends a sufficient length along sidewall 21 to accommodate a keeper in accordance with the invention (discussed below).

In the particular spike retainer configuration depicted in FIG. 3, channel 26 can be described as having a first portion 27 which extends along sidewall 21. Channel 26 has a second portion 28 which is a surface portion extending along outer surface 18 from bore 20 to an opening 29 extending through upper surface 18 of component 12. Opening 29 can alternatively be described as being a third portion of channel 26.

In accordance with the invention, a keeper 30 can be provided to assist in retaining a spike with receiving region 22 of bore 20. In the configuration shown in FIGS. 3 and 4, retainer 30 can be described as having a first end 31, a second end 32 and three segments 35, 36 and 37. A first segment 35 extends between first end 31 and a first bend 33. At least a portion of first segment 35 can preferably be inserted within opening 29. In particular instances it can be preferable that opening 29 be of sufficient depth to allow an entirety of first segment 35 to be inserted into and housed within opening 29, as depicted. The width of opening 29 can be such that a gap is present between material 12 and the keeper as shown, or can alternatively be provided such that minimal or no gap is present. It can be advantageous to provide opening 20 to have an opening size only slightly larger than the dimensions of segment 35 to allow stable retention of the keeper.

Second segment 36 extends from first bend 33 to a second bend 34 of the keeper. Second segment 36 preferably spans the distance between bore 20 and opening 29 allowing insertion of segment 36 into portion 28 of channel 26. Although the depth of channel portion 28 is not limited to a particular value, it can be preferable that the depth of such channel portion is sufficient to allow keeper 30 to be housed within the channel such that second segment 36 does not extend beyond upper surface 18 of component 12.

Third segment 37 of keeper 30 extends from second bend 34 to second end 32. The lengths and relative lengths of segments 35, 36 and 37 are not limited to particular values. Preferably, the lengths of segments 35, 36 and 37 are such that keeper 30 is securely held within channel 26 and to function in assisting in retaining a spike within receiving region 22.

Keeper 30 can preferably be configured such that a first section of the keeper is housed within channel 26 while a second section extends into receiving region 22 in the absence of an inserted spike. As illustrated in FIG. 3, segments 35, 36 and a portion of segment 37 comprise a first section of the keeper within channel 26 while the portion of segment 37 nearest second end 32 extends beyond sidewall 21 into receiving region 22. Accordingly, as shown in top view FIG. 4, in the absence of a spike, keeper 30 can be seen to protrude beyond sidewall 21 into bore 20.

Figure 4:
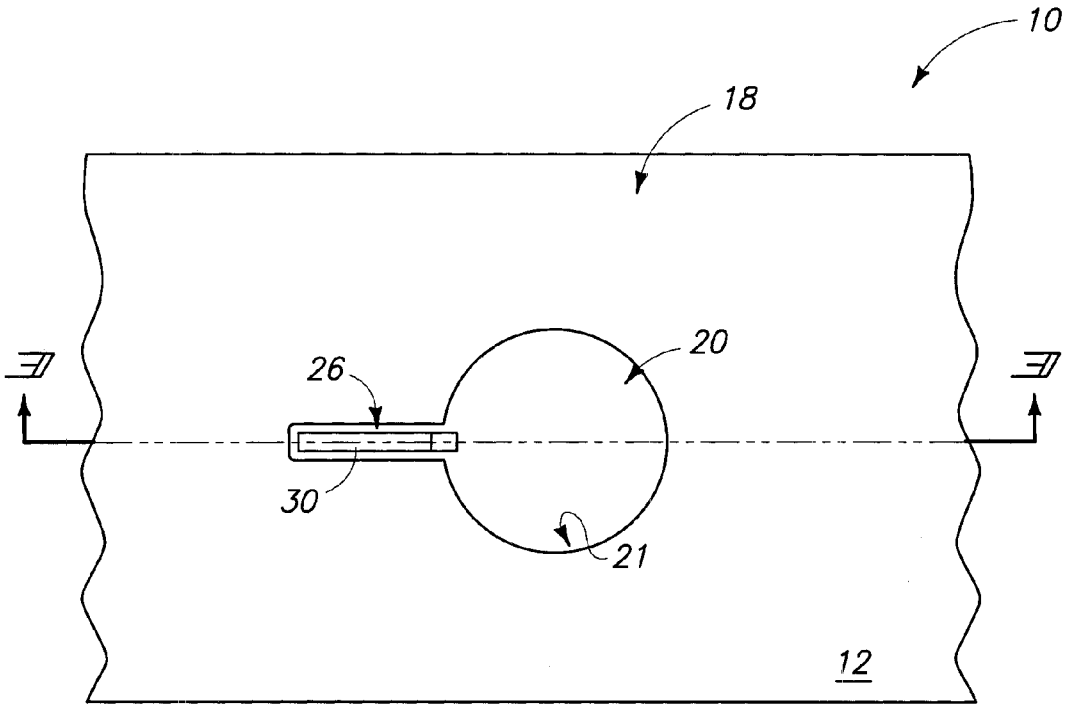
FIG. 4 is a fragmentary top view of the device configuration shown in FIG. 3, the cross-sectional view shown in FIG. 3 being taken along lines 3-3.
Figure 5:
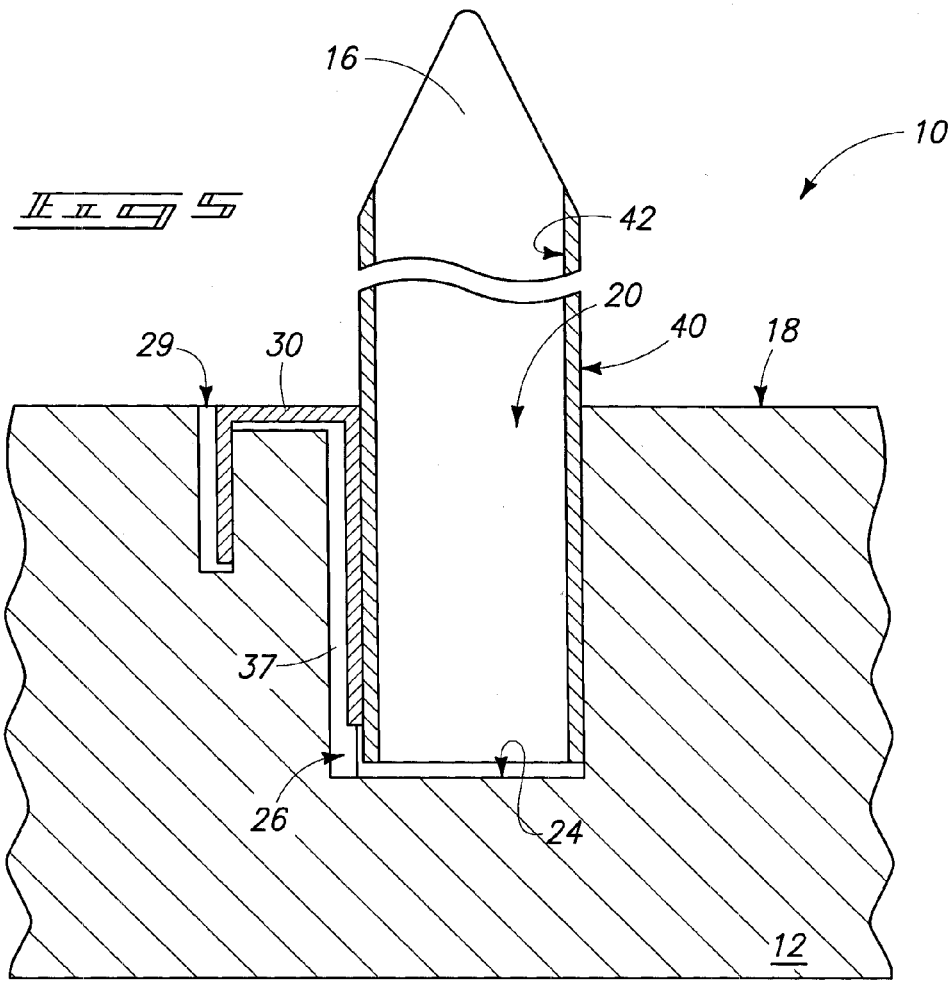
FIG. 5 is a fragmentary cross-sectional side view of the configuration shown in FIG. 4 having a spike inserted.

Referring to FIG. 5, such depicts the retainer configuration described with reference to FIGS. 3 and 4 upon insertion of a spike 16 into the receiving region of bore 20. In the FIG. 5 depiction, spike 16 is a hollow type spike having sidewall surfaces 40, 42, and specifically an inner sidewall surface 42 and an outer sidewall surface 40. Upon insertion of spike 16 into bore 20, segment 37 of keeper 30 retracts or substantially retracts into channel 26. Keeper 30 is preferably configured such that an entirety or a portion of the length of segment 37 contacts outer sidewall 40 of spike 16 and exerts a force upon such outer sidewall contact region. Keeper 30 preferably comprises a material which allows sufficient force to be applied to the spike by segment 37 to allow spike 16 to be retained within bore 20 prior to tire puncturing while allowing removal of spike 16 by a punctured tire. Exemplary materials which can be utilized for keeper 30 include but are not limited to metallic materials, plastics, and composites. In particular instances keeper 30 can preferably comprise, consist essentially of or consist of a spring steel.

In particular instances, keeper 30 can comprise a wire. Such wire can be, for example, round wire or flattened wire. In particular applications it can be beneficial to provide a flat type wire to allow an increased contact area between segment 37 and sidewall surface 40 of spike 16. Such increased contact surface can allow enhanced tension between the keeper and the spike. However, the thickness and shape of keeper 30 will additionally depend upon the specific material utilized.

Although spike 16 depicted in FIG. 5 is a hollow type spike, the invention additionally contemplates utilizing a solid (non-hollow) type spike for the retainer configuration shown in FIG. 5. Whether hollow or solid type spikes are utilized, the invention contemplates utilization of two or more keepers 30 in association with each spike (not shown). In particular instances it can be preferable to use multiple keepers to provide increased tension between the keepers and the spike such that increased force is required to remove the spike. Accordingly, the spike retention force can be adjusted as desired for a particular device and/or application.

Figure 6:
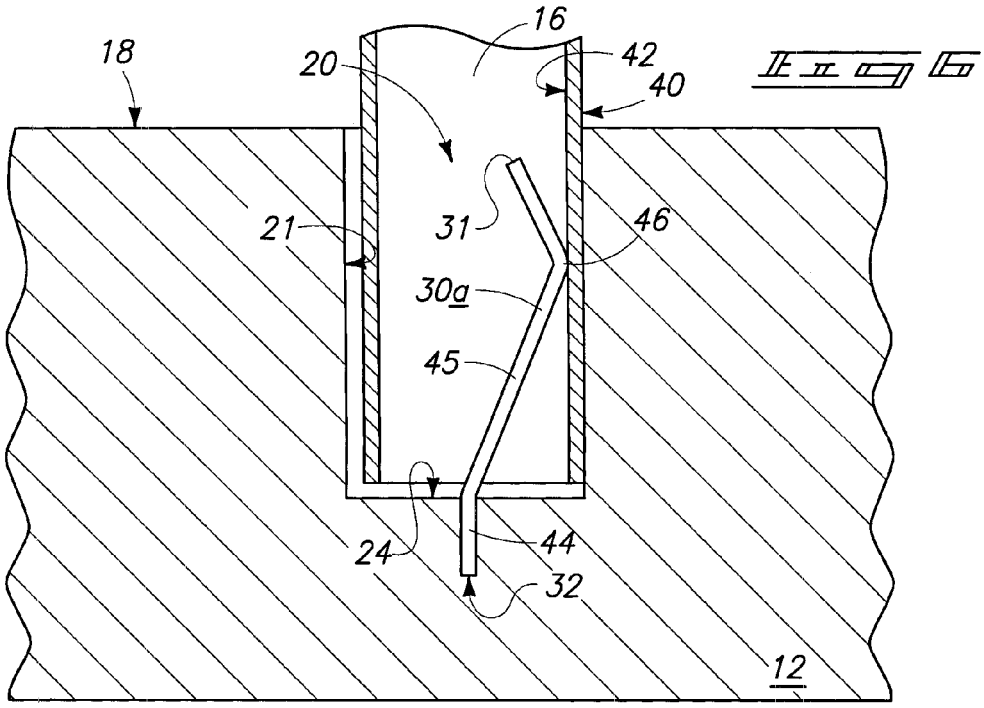
FIG. 6 is a cross-sectional fragmentary side view of a tire deflation device of an alternative configuration relative to that shown in FIG. 3.

Referring to FIG. 6, an alternative aspect of the invention is described relative to the configuration discussed above with reference to FIGS. 3-5. As illustrated in FIG. 6, an alternative keeper configuration 30*a* is shown having a first segment 44 embedded into material 12 through base surface 24 of bore 20. Keeper 30*a* additionally comprises a second segment 45 which extends from surface 24 into the receiving region of bore 20. Segment 45 can preferably comprise a bend 46 located at a distance from first end 31 to allow first end 31 to be spaced from sidewall 21 of opening 20 such that at least an uppermost portion of segment 45 extending from end 31 to bend 46 does not contact surface 21. The spacing of first end 31 away from sidewall 21 can allow a hollow spike 16 to be easily inserted between keeper 30*a* and sidewall 21 within the receiving region of bore 20. Accordingly, as shown in FIG. 6, upon insertion of spike 16, upper segment 45 of keeper 30*a* is disposed within spike 16.

Keeper 30*a* is preferably configured to allow a portion of segment 45 comprising at least bend 46, to contact an inner sidewall surface 42 of spike 16 and to exert force upon the sidewall region to thereby assist retention of spike 16 within bore 20. Appropriate materials for keeper 30*a* include any of the materials listed above with respect to keeper 30. Although FIG. 6 depicts segment 44 of keeper 30*a* as being centrally disposed within base surface 24, it is to be understood that the invention contemplates alternative positioning of segment 44 within base surface 24. Additionally, the invention contemplates utilization of two or more keepers 30*a* within a single bore.

Although FIG. 6 depicts keeper 30*a* as being utilized independently, keeper 30*a* can be utilized in addition to one or more keepers configured to contact the outer surface of a hollow spike. For example, the retainer configuration depicted in FIGS. 3-5 can be combined with the configuration shown in FIG. 6 such that at least one keeper contacts an outer surface of spike 16 and at least one keeper contacts an inner surface of spike 16.

Figure 7:
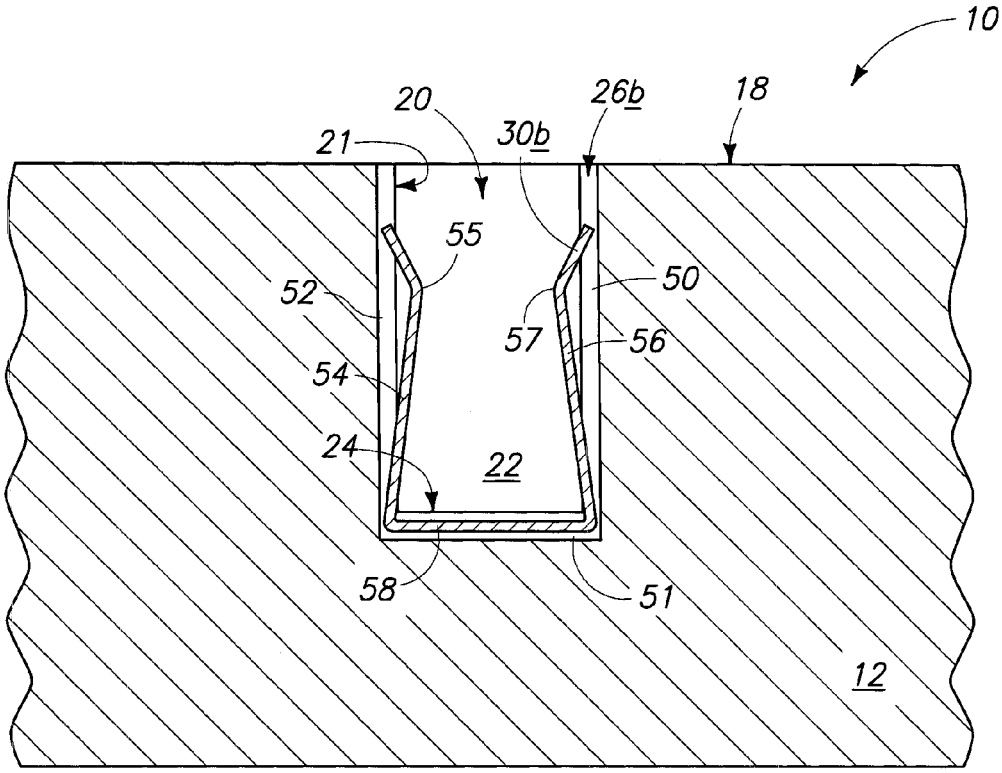
FIG. 7 is a fragmentary cross-sectional side view of another alternative configuration of a tire deflation device relative to that shown in FIG. 3.
Figure 8:
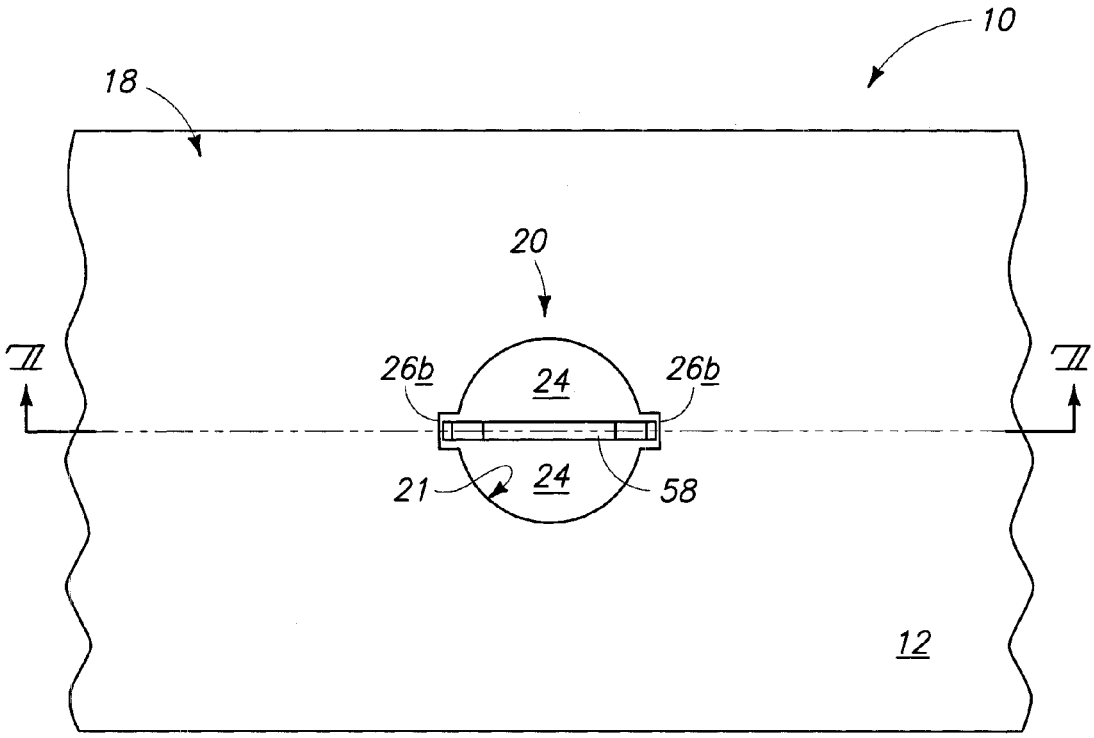
FIG. 8 is a fragmentary top view of the configuration of the tire deflation device depicted in FIG. 7, the cross-sectional view shown in FIG. 7 being taken along line 7-7.

An additional spike retainer configuration in accordance with the invention is described with reference to FIGS. 7-9. Referring to FIG. 7, as shown bore 20 extends into material 12 from upper surface 18. A channel 26*b* is provided which extends through base surface 24 across the width of bore 20 to provide a base portion 51 of channel 26*b*. Channel 26*b* can further comprise a first lateral portion 50 extending from base portion 51 toward upper surface 18. Lateral portion 50 can be described as extending from sidewall surface 21 of bore 20 into material 12. A second lateral portion 52 of channel 26*b* can be provided opposing first lateral portion 50.

As shown in FIG. 7, channel portions 50 and 52 can extend the entire depth of bore 20 through surface 18. Alternatively, lateral portions 50 and 52 can extend less than an entirety of the depth of bore 20 from base surface 24. In particular applications it can be preferable that lateral portions 52 and 50 of channel 26*b* extend less than the entire distance to surface 18 to provide an increased tension between an appropriate keeper and an inserted spike (discussed below). A top view of the retainer configuration shown in FIG. 7 is depicted in FIG. 8. Viewed from the top, channel 26*b* can be seen to traverse base surface 24 and extend outwardly through surface 21 on opposing sides of bore 20. Although channel 26 is shown to traverse base surface 24 in a direction substantially parallel with the longitudinal axis of component 12, it is to be understood that the directionality of such channel is not limited and that the invention contemplates alternative directions of traversal.

Referring again to FIG. 7, a keeper configuration 30*b* is shown. Keeper 30*b* can be described as comprising a first lateral segment 54 comprising a first bend 55 disposed at first distance above base surface 24 of opening bore 20. Keeper 30*b* additionally comprises a second lateral segment 56 which has a second bend 57 disposed at a second distance above base surface 24. Although bends 55 and 57 are shown as being disposed at substantially equivalent distances from surface 24, the invention additionally contemplates configurations where one of bends 55 and 57 is closer to surface 24.

Keeper 30*b* additionally comprises a base segment extending between first and second lateral segments 54 and 56. Although base portion 51 of channel 26*b* is shown as having sufficient depth to allow an entirety of base segment 58 of keeper 30*b* to be housed beneath surface 24 within channel 26*b* it is to be understood that the invention contemplates a shallower base channel portion.

Keeper 30*b* can preferably be configured such that at least a portion of each of lateral segments 54 and 56 extend beyond surface 21 into spike receiving region 22 of bore 20 prior to insertion of a spike. As shown in FIG. 9, insertion of spike 16 into bore 20 can preferably retract at least a portion of each lateral segment 54 and 56 into the lateral portions of channel 26*b*. Preferably a portion of each lateral segment 54, 56 comprising at least respective bend 55, 57 contacts outer surface 40 of spike 16. Keeper 30*b* is preferably configured to exert force on spike 16 to assist in retaining the spike within the bore at least until sufficient counterforce is exerted to overcome the tension between the keeper and the spike. Appropriate materials for keeper 30*b* can be, for example, any of the materials described above with respect to keepers 30 and 30*a*.

Figure 9:
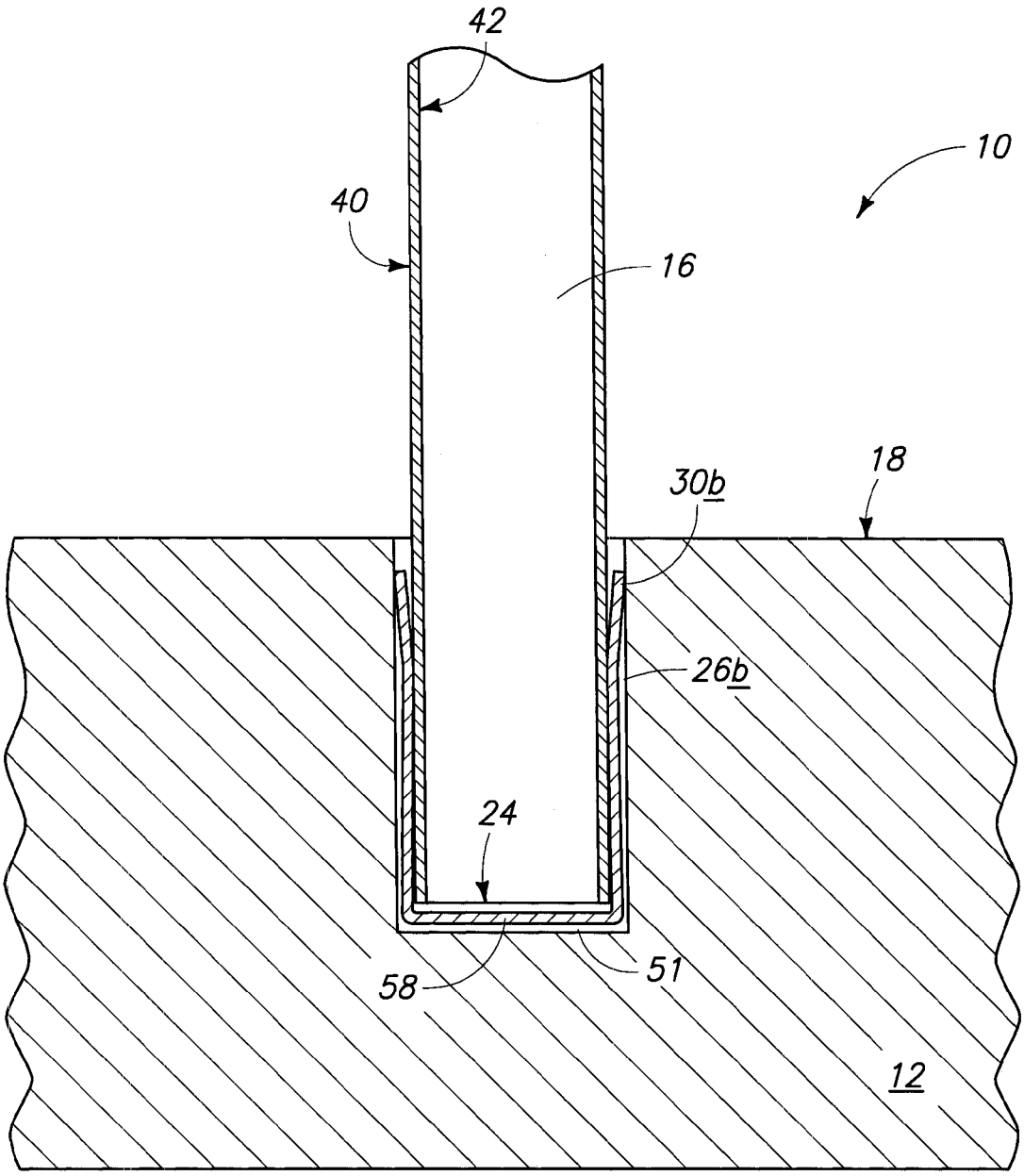
FIG. 9 is a fragmentary cross-sectional side view of the retainer configuration shown in FIG. 7 having a spike inserted.

Although keeper 30*b* is shown as being utilized independently, the configuration shown in FIG. 9 can be combined with one or more additional keeper configurations such as either of the two configurations discussed above. Additionally, the configuration shown in FIG. 9 can be adapted to allow two or more keepers having the configuration of keeper 30*b* to be utilized within a single bore.

The reversible retainer configurations described above can advantageously allow spike to be full seated within the bore without obstruction by more bulky types of retaining components such as grommets. As shown in FIG. 9, spike 16 can be inserted to contact base surface 24. Although the configurations illustrated in FIGS. 5 and 6 show spike 16 being spaced from base surface 24, it is to be understood that these configurations can also allow the spike to be positioned to contact the base surface. The invention contemplates utilization any of the described keepers and retainer configurations with the spike fully inserted and contacting the base surface of the bore to enhance spike stability. It is, however, to be understood that each of the described configurations can functionally reversibly retain the spike even in the event that the spike is not fully inserted or does not directly contact the base surface.

Methodology of the invention includes forming tire deflation devices and/or components to comprise one or more of the retainer configurations described above. Methodology of the invention can in some instances comprise methods of reversibly retaining a spike by providing a bore into a material such as a rotatable shaft or other component into which a spike is to be inserted. A channel can be provided through a sidewall of the bore and a keeper can be positioned such that a first segment of the keeper is housed within the channel while a second portion of the keeper extends into the bore as described above.

A spike can be inserted into the bore such that insertion retracts at least a portion of the keeper into the channel. In particular instances a single keeper will be utilized per spike. In other configurations two or more keepers can be utilized to provide additional force on a spike. The force exerted on a given spike by the keeper(s) can preferably be overcome by force exerted on the spike by a tire upon insertion or puncturing of the tire by the spike allowing the spike to be withdrawn from the bore to remain inserted within the tire.

Alternatively, spike retention methodology of the invention can comprise inserting or otherwise providing a segment of a keeper through a base surface of the bore into which the spike is to be reversibly retained. A second segment of the inserted keeper is disposed within the bore such that upon insertion of a hollow spike, at least a portion of the keeper is within the hollow spike.

In particular applications, methodology of the invention can comprise providing at least one keeper configured to contact an inner surface of a hollow spike and at least one keeper configured to contact an outer surface of the spike. Methodology of the invention can further comprise adapting the retainer configurations presented above to be utilized for a particular deflation device and/or spike configuration.

A tire deflation device in accordance with the invention can comprise at least one component having one or more of the spike retainer configurations described above. In particular instances a device in accordance with the invention will comprise the exemplary rotatable shaft device configuration as described with reference to FIGS. 1 and 2. Alternatively, a device in accordance with the invention can be an alternative device configuration to which the spike retainer configurations of the invention have been adapted.

The invention contemplates adaptation of the retainer configurations of the invention to be utilized for reversibly retaining spikes in any tire deflation device where reversible spike retention is desired. It is to be understood that the invention further contemplates adaptation and utilization of the described retainer configurations for reversibly retaining spikes, pegs, rods, or other insertable components into bores, holes, or other openings within devices other than tire deflation devices. The number, type and materials of the keepers of the invention can be determined or adjusted based upon the desired disengagement force for removal of the insertable component.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A tire deflation device comprising:

a component including a bore in a material, the bore comprising:
- a receiving region;
- a sidewall surface; and
- a base surface;

a channel extending from the sidewall surface into the material;

a keeper having a first section housed within the channel and a second section which extends past the sidewall surface into the receiving region; and a spike removably insertable into the bore;

wherein the keeper is configured such that at least a portion of the second section retracts into the channel upon insertion of the spike into the receiving region.

2. The tire deflation device of claim 1 wherein the keeper comprises a metal.

3. The tire deflation device of claim 2 wherein insertion of the spike into the receiving region disposes the spike between the first lateral segment and the second lateral segment of the keeper.

4. The tire deflation device of claim 2 wherein the keeper is configured such that upon insertion of the spike into the bore at least a portion of the first segment retracts into the first lateral portion of the channel, and at least a portion of the second segment retracts into the second lateral portion of the channel.

5. A tire deflation device comprising:

a component including a bore in a material, the bore comprising:
- a receiving region;
- a sidewall surface; and
- a base surface;

a channel extending from the sidewall surface into the material, the channel comprising a base portion across the base surface of the bore, a first lateral portion extending from the base surface toward an outer surface of the material, and a second lateral portion extending from the base surface toward the outer surface of the material;

a keeper having a first section housed within the channel and a second section which extends past the sidewall surface into the receiving region, the keeper comprising a base segment and a first lateral segment and a second lateral segment, the base segment being housed within the base portion of the channel and disposed between the first lateral segment and the second lateral segment, wherein the first lateral segment comprises a first bend disposed at a first distance from the base surface and wherein the second lateral segment comprises a second bend disposed at a second distance from the base surface, wherein the keeper comprises a first end and a second end and wherein the first end is closer to the first lateral channel portion than the first bend, and the second end is closer to the second lateral channel portion than the second bend, at least prior to insertion of a spike into the receiver region; and a spike removably insertable into the bore.

* * * * *